US005692348A

United States Patent [19]

Ambrosino

[11] Patent Number: 5,692,348

[45] Date of Patent: Dec. 2, 1997

[54] BUILDING WATER-DRAINING SPANDREL

[76] Inventor: Michael Ambrosino, 3672 Naomi St., Seaford, N.Y. 11783

[21] Appl. No.: 667,591

[22] Filed: Jun. 24, 1996

[51] Int. Cl.[6] ..... E04B 1/70

[52] U.S. Cl. ..... 52/169.5; 52/169.14; 405/43; 405/45

[58] Field of Search ..... 405/43, 45, 36, 405/52, 303, 46–50; 52/169.5, 169.14

[56] References Cited

U.S. PATENT DOCUMENTS

| | | | |
|---|---|---|---|
| 1,734,777 | 11/1929 | Pike | 52/169.14 X |
| 3,092,933 | 6/1963 | Closner et al. | 52/169.14 X |
| 4,733,989 | 3/1988 | Harriett | 405/53 |
| 4,745,716 | 5/1988 | Kuypers | 52/169.5 |
| 4,840,515 | 6/1989 | Preese | 405/43 X |
| 5,044,821 | 9/1991 | Johnsen | 52/169.14 X |
| 5,184,437 | 2/1993 | Woong et al. | 52/169.5 |

FOREIGN PATENT DOCUMENTS

| | | | |
|---|---|---|---|
| 2155076 | 9/1985 | United Kingdom | 52/169.5 |

*Primary Examiner*—Dennis L. Taylor
*Attorney, Agent, or Firm*—Myron Amer

[57] ABSTRACT

A spandrel supporting an upper story upon a lower story of a construction having exterior and interior walls bounding a site for collecting water seepage through the porosity of the brick construction material of the exterior wall, on which spandrel there is a waterproofing membrane to confine the water seepage to the space between the walls and a porous drainage fabric to drain excessive water to the exterior and as to nominal seepage to allow air flow through the drainage fabric to cause its evaporation.

1 Claim, 1 Drawing Sheet

BUILDING WATER-DRAINING SPANDREL

The present invention relates generally to improvements in building constructions, and more particularly to obviating the adverse consequences of water seepage therein.

In building constructions, the construction material of choice is bricks or the like which due to internal porosity unavoidable allows water seepage to take place. Thus, a building facade typically has an exterior brick wall which is first impinged upon by weather elements of rain and snow and the resulting water seepage therefrom is into an air space created behind the exterior brick wall, this air space being bounded by the exterior brick wall and an interior brick wall in a rearward clearance position therefrom. The drainage of this water seepage from the air space is critical since the unremoved water undergoes a freezing and thawing cycle and often results in undue pressure exerted either against the rear of the external wall or against the front of the interior wall producing cracks in the brick construction material of these walls.

EXAMPLE OF THE PRIOR ART

Practices for obviating the adverse consequences of water seepage in building constructions are documented in prior patents, one such patent pertinent to note because it uses a waterproofing membrane to exercise control over the water seepage, as is done in accordance with the present invention, in U.S. Pat. No. 4,943,185 issued to McGuckin et al. for combined Drainage and Waterproofing Panel System for Subterranean Walls on Jul. 24, 1990. In McGuckin et al. water seepage into backfill supporting a subterranean wall is prevented by the waterproofing membrane, but apart from this limited utility, the water is not controlled as to flow as would assist in draining the water from an air space between brick walls.

Broadly, it is an object of the present invention to advantageously use in a building facade a waterproofing membrane and means cooperating therewith for effective water seepage drainage, thereby overcoming the foregoing and other shortcomings of the prior art.

More particularly, it is an object to provide a combination waterproofing and water flow-through assembly to line the noted air space and substitute for the current practice of draining water seepage, wherein the within inventive assembly is not vulnerable to being occluded or similarly diminished in its utility for the purposes intended, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
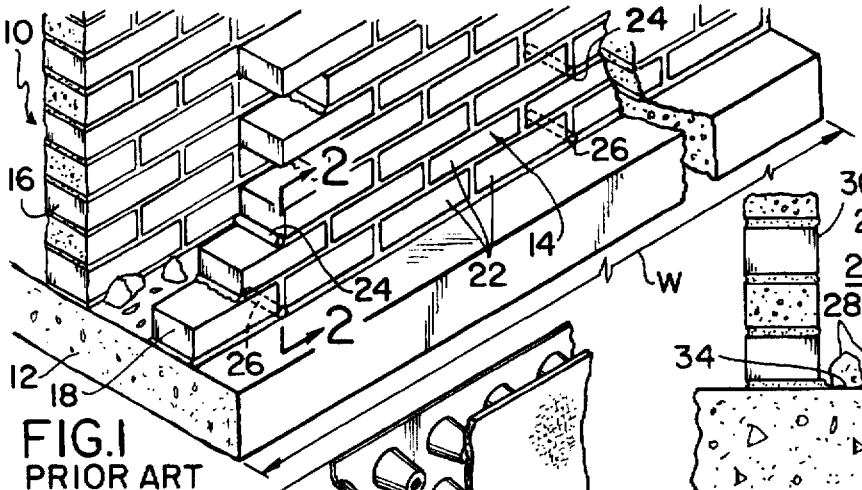
FIG.1 PRIOR ART
FIG. 1 is a partial perspective view of a building construction, partly broken away, to illustrate an air space bounded between interior and exterior brick walls and a prior art currently used practice of aerating the air space and draining therefrom water seepage through a porosity of the exterior wall bricks.
Figure 2:
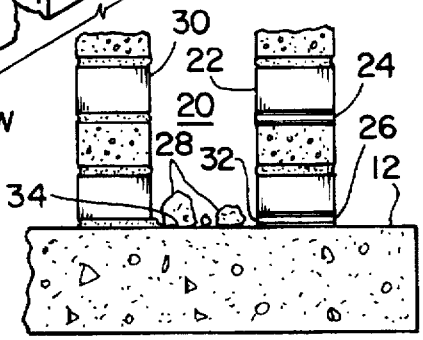
FIG.2 PRIOR ART
FIG. 2 is a cross sectional view taken along lines 2—2 of FIG. 1.
Figure 4:
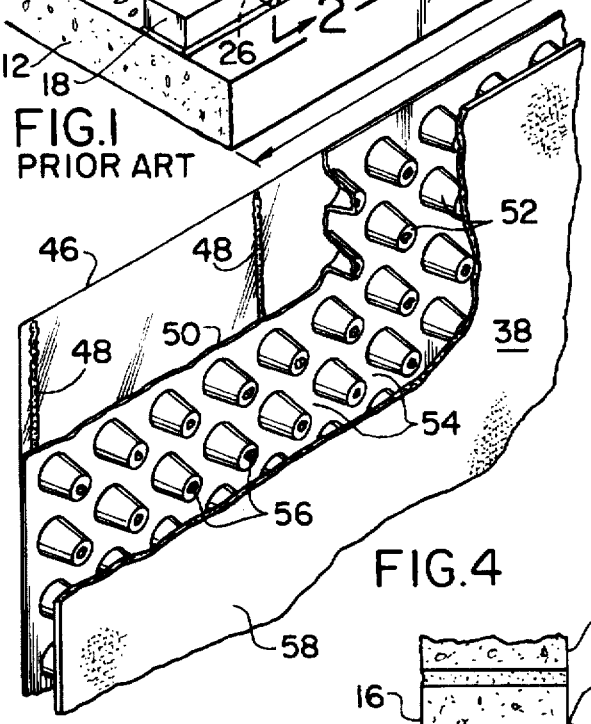
Figure 3:
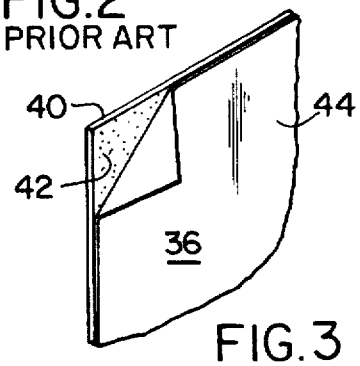
Figure 5:
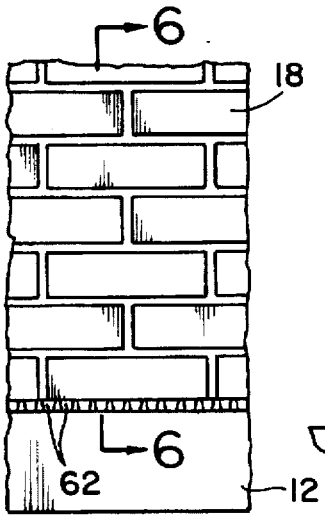
Figure 6:
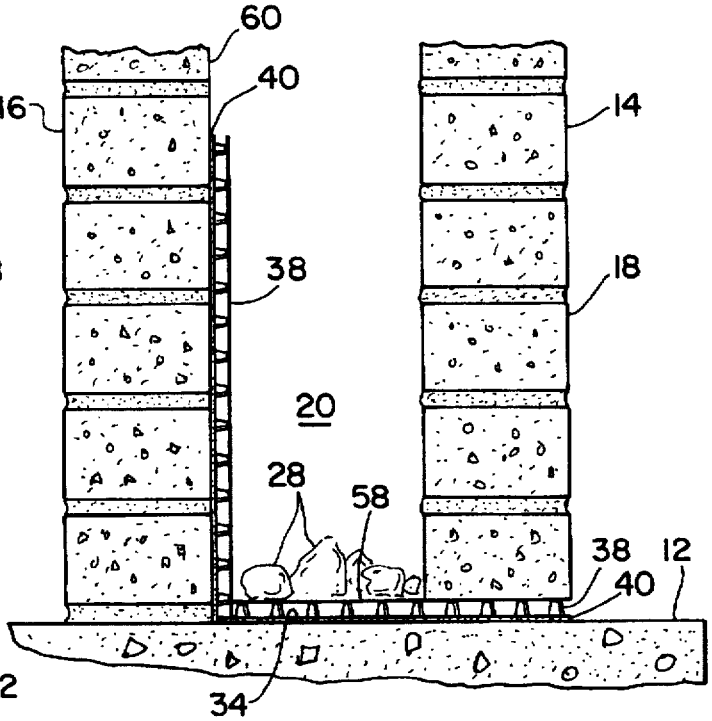

Remaining FIGS. 3–6, inclusive, illustrate improvements to the illustrated prior art practice of FIGS. 1 and 2 wherein, more particularly, FIGS. 3 and 4 are isolated partial perspective views respectively of waterproofing and water drainage components which cooperate for achieving the improvements;

FIG. 5 is a front elevational view of an exterior wall of a building construction embodying the within inventive air space water seepage drainage improvements; and FIG. 6 is a side elevational view, in section taken along line 6—6 of FIG. 5.

Shown in FIG. 1 is a portion of a known building construction, generally designed 10, such as the construction to be understood to be exemplified by an attached city brownstone typically twenty feet wide, denoted as at W, and usually four stories high, each story in turn being twelve to fifteen feet. As further well-known, between each story there is located a so-called spandrel 12 consisting typically of a concrete slab which is effective to relieve the pressure of the weight of the building facade, generally designated 14 of an upper story or stories upon a lower story.

Pertinent to the within invention and as is well-known, the facade 14 consists of a back-up or interior brick wall 16 and in a clearance forward position therefrom an exterior brick wall 18 such that in the clearance between the walls 16 and 18 there is bounded an air space 20, one of several building functions of which is to entrap water seepage which cannot be prevented from occurring through the porosity of the exterior wall bricks 22, and which water seepage would, of course, be a more serious problem if occurring through the interior wall 16 and into the dwelling area of the building.

The current or prior art practice of draining water seepage from air space 20 contemplates positioning in the exterior wall 18 so-called plural vent tubes 24 every twenty-four inches along the width of the facade 14 in the third brick row or course, and at approximately the same widthwise spacing plural weep tubes 26 at the location of the bottom course and the spandrel 12. If functioning ideally, ventilation through the vent tubes 24 into the air space 20 will remove water seepage by evaporation, and what does not evaporate will drain from the air space 20 through the weeps tubes 26. The removal of water seepage as just described often does not occur, it being better understood and underlying the present invention, that particulate 28 separating from the walls' brick construction 22, 30 bounding the air space 20 accumulates at the bottom of the air space and occludes the inlets 32 of the weep tubes 26 preventing exiting flow therethrough, a condition further complicated by the nominal diameter size of the tubes and no gravity flow assistance because of the horizontal orientation of the spandrel area 34 delimited between the walls 16 and 18 and bounding the bottom of the air space. Water which is not effectively removed through the weep tubes 26 undergoes a freezing and thawing cycle and this in turn usually results in undue pressure against the facade wall 18 and breakage in the brick construction material 22 thereof.

In substitution for the vent and weep tubes 24 and 26 of the prior art practice depicted in FIGS. 1 and 2, use is made of cooperating components 36 (FIG. 3) and 38 (FIG. 4), the former being a commercially available waterproofing membrane 36, such as that obtained from W. R. Grace & Co. of Cambridge, Mass., and the latter a commercially available water drainage fabric-like material 38 in sheet form, such as that also obtained from W. R. Grace & Co. sold under the trademark "Hydroduct HZ". Waterproofing membrane 36 typically available in a supply roll from which length portions are removed consists of a water impervious substrate 40 presenting a functional adhesive surface 42 when a chemically-inert helically interwoven in the supply roll release cover 44 is removed.

The water drainage-fabric 38 consists of a first plastic ply 46 to which spaced adhesive deposits 48 complete an adhesive attachment to a second plastic ply 50 formed with any array of ⅞ inch high truncated cones, individually and collectively designated 52, such that in the surrounding areas 54 about the cones 52 there is unobstructed fluid flow. Adhesive deposits 56 on the tops of the cones 52 hold a coarse felt fabric 58 in covering relation over the two ply assembly 46, 50.

As best understood from FIGS. 5 and 6, the waterproofing membrane 36 and water-drainage fabric 38 are used in selected cooperating widths and cooperating positioned relation to each other to maximize drainage of water seepage from the air space 20, as will now be explained. More particularly, after erection of the interior brick wall 16 at a spaced inward location upon the horizontally supported spandrel 12, the release cover 44 is removed and the waterproofing membrane 36 is adhered by its exposed adhesive surface 42 to the interior wall surface 60 in facing relation to the air space 20, adhered to spandrel surface 34 bounding the bottom of the air space 20, and adhered slightly beyond the air space 20 so as to occupy a location that will be beneath the exterior wall 18.

Next, the water-drainage fabric 38 in a selected size and shape that is adapted to fit in covering relation over the already adhered in place waterproofing membrane 36 is adhesively attached, by contact of its ply 46 with the membrane substrate 40, so that both components 36 and 38 in attached relation to each other line the rear and bottom of the air space 20.

Lastly, the exterior wall 18 is erected upon the end of the lateral extension of the adhered components 36 and 38.

It is to be noted and understood that the widthwise selected dimension of the components 36 and 38 corresponds to the width W of the building construction 10 so that for the entire width of the air space 20 accumulating particulate 28 is upon the felt 58 and of no consequence, and water seepage through the porosity of the exterior wall 18 is by the air-space lining waterproofing membrane 36 confined to the air space 20 from which it readily drains through the numerous, entire building widthwise drainage exit openings, individually and collectively designated 62. Venting communication through the openings 62 between the air space 20 and the outdoors also facilitates removal of water seepage by evaporation.

While the apparatus for draining water seepage herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. Water drainage improvements for a multi-story building construction of a type having an interior space bounded by an interior wall means and an exterior wall means of brick construction material in a clearance position spaced forwardly thereof into which clearance therebetween there is water seepage through a porosity of said brick construction material of said exterior wall means, said water drainage improvements for the draining of said water seepage comprising building-wide spandrel means in a horizontal orientation located at least at one intersection of adjacent stories having an operative position in spanning relation interposed between said interior and exterior wall means to correspondingly delimit an operative surface thereon in facing relation to said clearance space, a waterproofing membrane means of a selected width having an operative position supported on said internal wall means and upon said spandrel means operative surface both in facing relation to said clearance space so as to confine any water seepage to said clearance space and wherein a free end of said waterproofing membrane means in said operative position thereof has an interposed position extending between said exterior wall means in said superposed position thereof upon said spandrel means, and a water drainage-fabric means of similar width as said waterproofing membrane means disposed in superposed relation upon said waterproofing membrane means so as to have an operative position effective to contribute to drainage flow from said clearance space of any water seepage confined thereto by said waterproofing membrane means, said selected width of said waterproofing membrane means and of said water drainage fabric means being at least equal to the width of said building construction, whereby any water seepage when of a significant amount is drained effectively through said construction building-wide water drainage fabric means and when of a nominal amount is evaporated by a reverse direction flow of ambient air through said water drainage fabric means into said clearance space.

* * * * *